US008887951B2

(12) United States Patent
Guindulain Vidondo

(10) Patent No.: US 8,887,951 B2
(45) Date of Patent: Nov. 18, 2014

(54) UNITARY EXTRACTOR SYSTEM FOR PRODUCTS IN DISPENSING MACHINES

(75) Inventor: Félix Guindulain Vidondo, Peralta (ES)

(73) Assignee: Jofemar, S.A., Peralta (Navarra) (ES)

( * ) Notice: Subject to any disclaimer, the term of this patent is extended or adjusted under 35 U.S.C. 154(b) by 207 days.

(21) Appl. No.: 11/435,998

(22) Filed: May 17, 2006

(65) Prior Publication Data

US 2006/0261081 A1 Nov. 23, 2006

(30) Foreign Application Priority Data

May 18, 2005 (ES) ..... 200501205

(51) Int. Cl.
*G07F 11/00* (2006.01)
*G07F 11/42* (2006.01)
*G07F 11/58* (2006.01)

(52) U.S. Cl.
CPC ..... *G07F 11/42* (2013.01); *G07F 11/58* (2013.01)
USPC ..... 221/227; 221/7; 221/279

(58) Field of Classification Search
USPC ..... 221/227, 124
See application file for complete search history.

(56) References Cited

U.S. PATENT DOCUMENTS 2,500,438 A * 3/1950 Tandler et al. ..... 221/13
2,590,736 A * 3/1952 Tandler et al. ..... 194/244
2,784,872 A * 3/1957 Lux ..... 221/207
3,767,084 A * 10/1973 Bayha ..... 221/279
3,991,907 A * 11/1976 Kull ..... 221/84
4,008,828 A * 2/1977 Branchaud ..... 221/241
4,134,520 A * 1/1979 Collins et al. ..... 221/129
4,221,376 A * 9/1980 Handen et al. ..... 271/149
4,336,892 A * 6/1982 Cox et al. ..... 221/125
4,512,453 A * 4/1985 Schuller et al. ..... 194/200
5,110,192 A * 5/1992 Lauterbach ..... 312/71
5,263,596 A * 11/1993 Williams ..... 221/153
5,531,355 A * 7/1996 Ullmann et al. ..... 221/191
5,873,489 A * 2/1999 Ide et al. ..... 221/279
5,964,373 A * 10/1999 Hucknall ..... 221/6
6,082,556 A * 7/2000 Primiano et al. ..... 211/59.2

(Continued)

FOREIGN PATENT DOCUMENTS

JP 10302140 A * 11/1998
JP 11154268 A * 6/1999

(Continued)

*Primary Examiner* — Gene Crawford
*Assistant Examiner* — Kelvin L Randall, Jr.
(74) *Attorney, Agent, or Firm* — Klauber & Jackson LLC

(57) ABSTRACT

Unitary extractor system for products in dispensing machines for food and drinks, the products being deposited in corresponding compartments of a series of trays, which present a centrally open laminar base, with a belt provided with a plurality of toothed projections being fitted in relation to the open central part of the laminar base, the unitary extractor system for the product to dispense being defined by a single pusher (10) secured to a belt (5) provided with a plurality of projections, this securing being materialized by means of a rotary arm of the pusher restrained by a spring, with its lower end being positioned between two curved projections of the belt (5), the pusher (10) remaining in its initial position backed on to the product (11) that is most internal of all the products aligned in the corresponding compartment (3) of a tray (2), each of the compartments (3) presenting in its upper part a pair of lateral strips (6) converging towards the center.

2 Claims, 6 Drawing Sheets

(56) References Cited

U.S. PATENT DOCUMENTS

| | | | | |
|---|---|---|---|---|
| 6,253,954 | B1 * | 7/2001 | Yasaka | 221/93 |
| 6,478,187 | B2 * | 11/2002 | Simson et al. | 221/75 |
| 6,691,891 | B2 * | 2/2004 | Maldonado | 221/279 |
| 2001/0042756 | A1 * | 11/2001 | Maldonado, Sr. | 221/268 |
| 2002/0017531 | A1 * | 2/2002 | Adriani | 221/15 |
| 2002/0092861 | A1 * | 7/2002 | Zerwig et al. | 221/126 |
| 2003/0000956 | A1 | 1/2003 | Maldonado | |

FOREIGN PATENT DOCUMENTS

| | | | | |
|---|---|---|---|---|
| JP | 2000259941 | A | 9/2000 | |
| JP | 2004005184 | A | 1/2004 | |
| WO | WO 9708667 | A1 * | 3/1997 | G07F 11/58 |

* cited by examiner

UNITARY EXTRACTOR SYSTEM FOR PRODUCTS IN DISPENSING MACHINES

RELATED APPLICATION

The present application claims priority from Spanish Application Serial No. 200501205, filed on May 18, 2005. Applicants claim priority under 35 U.S.C. §119 as to said Spanish application, and the entire disclosure of said application is incorporated herein by reference in its entirety.

OBJECT OF THE INVENTION

As stated in the title of this specification, the following invention refers to a unitary extractor system for products in dispensing machines, being of the type of and/or cards and which can dispense food products, refrigerated or otherwise, and drinks, the products to be dispensed being stored in corresponding compartments of a plurality of stacked trays, in such a way that the unitary extractor system is based on a chain or belt, provided with a toothed curve, arranged in a position central to the respective compartment in relation to a central opening of the laminar base for the depositing of products, to which toothed chain or belt is fixed a single retaining pusher for the products in their extraction and whose compartments present in their forward part a pair of lateral strips converging towards the center for securing the products.

So, the pusher for pushing the products is secured to the chain or belt by one of its arms which is restrained by the action of a spring, being kept between two teeth of that chain or belt.

In this way, due to having a single element for pushing the products, the entire space of the compartments is optimised which will be completely filled with the corresponding products backed on to each other and with the pusher manually arranged in the most internal part of the compartment for pushing the products in the advance of the toothed chain or belt in the extraction operation for a product, while the pair of lateral strips, converging towards the center of the compartment, act as a retaining element for the first product ready for its extraction.

FIELD OF APPLICATION

This specification describes a unitary extractor system for products in dispensing machines, being of application in all types of dispensing machine which function by means of the introduction of coins, bank notes and/or cards and which can dispense food products, refrigerated or otherwise, and drinks.

So, the dispensing machine will be able to be installed in very diverse places, such as in companies, public buildings, hospitals, airports, railway and coach stations, schools, etc.

Likewise, the dispensing machine will be able to be of use for the dispensing of live bait, and can be installed in stores and shopping centers, especially in sections relating to fishing and in places for fishing.

PRIOR ART OF THE INVENTION

As it is known, there exists a wide diversity of automatic dispensing machines on the market which function by means of the introduction of coins, cards and/or bank notes, being able to consider more specifically those machines which incorporate refrigeration equipment and which are used for the dispensing of cold drinks or food products which, on account of their components, need to be kept at a low temperature until they are consumed, the machines presenting some rotating bodies around two shafts, one upper and the other lower, provided with some arms which, by way of compartments, house the products to be dispensed.

In this type of dispensing machine the distance between the arms defining the compartments is fixed so that, depending on the product it is wished to place therein, the actual volume of that product can mean that there is a lot of space unused.

We can also cite Invention Application P9002132 and P9202368 in which the product to dispense remains in an upright vertical position in respective compartments in a spiral, in such a way that with the successive rotation of the seating platform for the products the latter are extracted by means of the corresponding extractor mechanism.

We can likewise cite Invention Application P9601138 in which the products, cold drinks, are deposited in a horizontal position in a series of compartments inclined towards an open vertical duct which leads to an extractor mechanism.

Similarly, we can cite Invention Application P9800864 with publication number ES 2137895 for: Dispensing machine, which presents a series of trays provided with compartments, these compartments presenting a central opening in their base, in relation to which a chain is provided between two horizontally aligned shafts, the dragging system for the products being defined by a series of bodies secured to said chain, rotationally attached to which bodies are some respective transverse plates which push the products in the advance of the chain driven by the corresponding motor which transmits the movement to one of the shafts.

The dragging bodies secured to the respective chains are able to be positioned in accordance with the size of the product housed in each of the compartments.

Also, the transverse plates pushing the products in their expulsion remain on the base of the compartment housing the products in the vertical position, and via their lower part they rotate with respect to the fixed piece of the chain, occupying less space.

Moreover, in Addition Certificate P9802496 to the main patent P9800864, the dragging system for the products includes in the corresponding storage compartments for the products some belts, arranged in the open central part of the deposit base for the products, provided with a series of projections very close together, containing corresponding holes, to which are rotationally joined some dragging flat-bars for the products, in such a way that the dragging flat-bars for the products present a general rectangular shape, with a central offset in relation to their side backing on to the base of the compartment and of length similar to the width of the belt, being provided in relation to the end of the side of that offset with respective stubs for their rotating connection to the corresponding hole of the respective projection of the belt.

SUMMARY OF THE INVENTION

This specification describes a unitary extractor system for products in dispensing machines, being of the type of automatic dispensing machine which function by means of the introduction of coins, bank notes and/or cards and which can dispense food products, refrigerated or otherwise, and drinks.

The products are deposited in corresponding compartments of a plurality of trays, whose compartments present a laminar base open centrally, with a belt provided with a plurality of projections being fitted in relation to the open central part of the laminar base.

So, the unitary extractor system for the product to dispense is defined by a single pincer body secured to a belt provided with a plurality of projections, this securing being materialized by means of a rotary arm of the pincer restrained by a spring, with its lower end being positioned between two curved projections of the belt, the pincer remaining in its initial position backed on to the product that is most internal of all the products aligned in the corresponding compartment of a tray, each of the compartments presenting in its upper part a pair of lateral strips converging towards the center.

So, in the forward part of each of the compartments, a retainer has been provided for the pusher for the products, preventing their advance.

With the pusher for the products abutting on the retainer in the forward part of the compartment, when a new request is made for a product, the advance of the belt overcomes the action of the spring restraining the rotary arm of the pusher by means of which it is secured, and it can rotate freely.

In accordance with a first practical embodiment, the pusher for the products abuts on the retainer in the forward part of the compartment when the last product has been dispensed, in other words, there remains no further products to dispense.

On the other hand, in a second embodiment of the invention, the pusher for the products abuts on the retainer in the forward part of the compartment when the last product but one has been dispensed, there remaining just one product that has not been dispensed, in such a way that the users will have a product visible to them.

This practical embodiment is important for being able to know the number of sales "lost" since, when a user requests a product of which there only remains one unit, when making the request for it the system will be actuated, in other words, it will rotate the belt without dragging the pusher and, as the product is not dispensed, the operation can be counted as a "lost" sale, permitting it to be reliably known which are the products subject to the greatest demand.

In order to carry out the filling operation, the pusher will be returned to its initial position, manually, by overcoming the action of the spring restraining the rotary arm and sliding the pusher to the rear part of the belt, after which the compartment can be filled with the corresponding products.

The pair of lateral strips converging to the center, arranged in the forward part of each of the compartments, acts as a security element for the product located in first place for extraction, preventing it from being accidentally released, even when the machine is moved with the intention of causing the products to fall.

Likewise, in the extraction operation of a product, with the advance of the belt containing the products, the pair of strips give way, releasing the first product towards an extraction tray, while the product positioned in second place is halted by the pair of strips, at the same time as the belt is detained.

In order to complement the description that is going to be made forthwith, and with the aim of aiding a better understanding of characteristics of the invention, this specification is accompanied by a set of plans, wherein, by way of illustration only and not limiting, the most characteristic details of the invention are represented.

DESCRIPTION OF A PREFERRED EMBODIMENT

Figure 1:
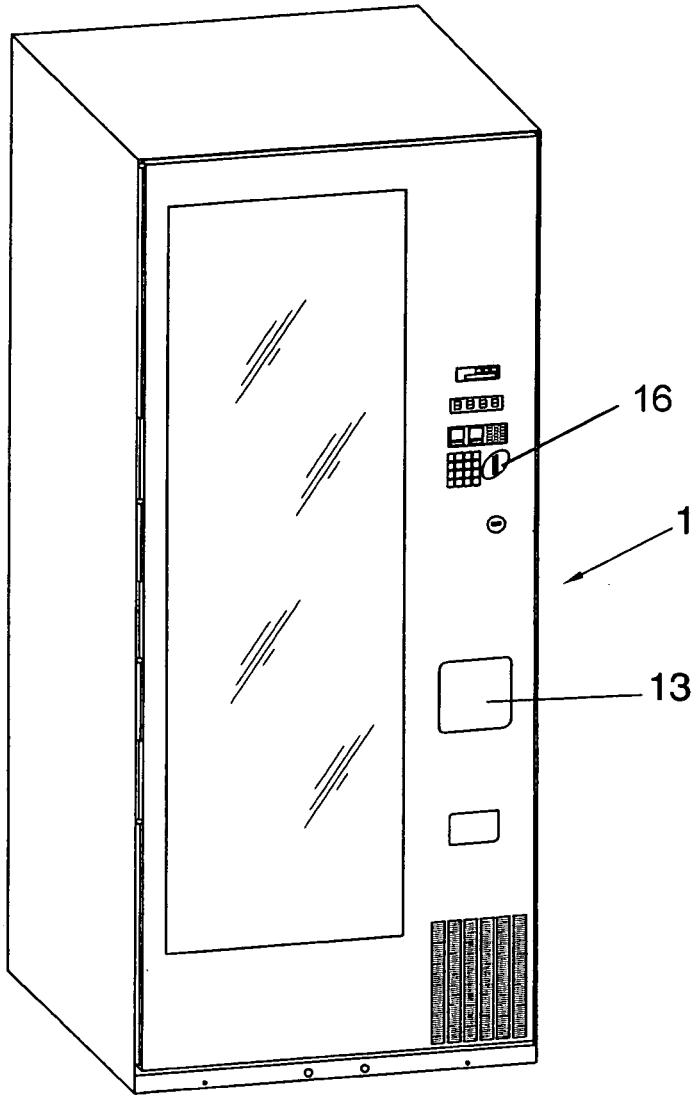
FIG. 1. Shows a perspective view of a dispensing machine, where its front can be seen with the necessary means for its functioning.
Figure 2:
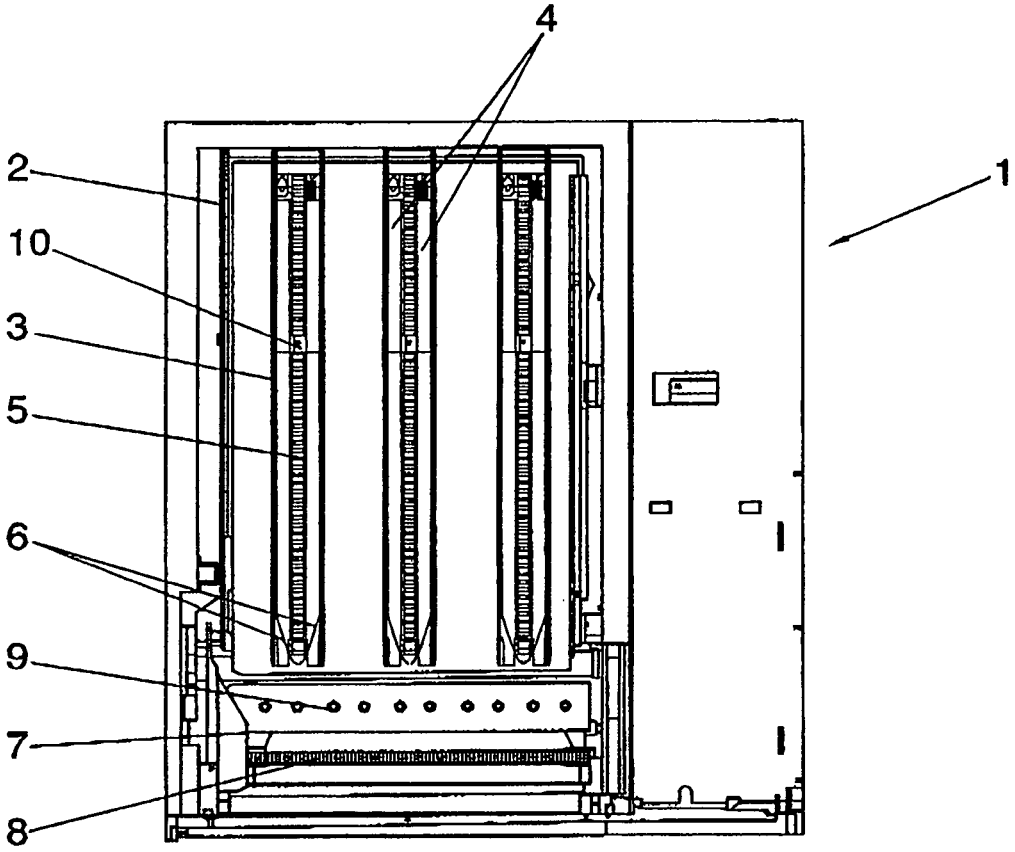
FIG. 2. Shows a plan view according to a transverse section of the machine, where a tray for depositing the products can be seen, divided into certain compartments, converging on a reception tray for the products to be dispensed.
Figure 3:
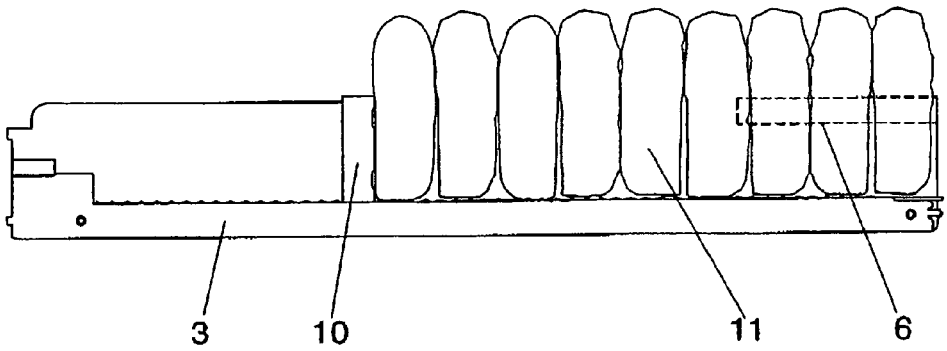
FIG. 3. Shows a side elevation view of a compartment for depositing the products, where the pusher can be seen, together with a retaining strip for the products in the form of a dashed line.
Figure 4:
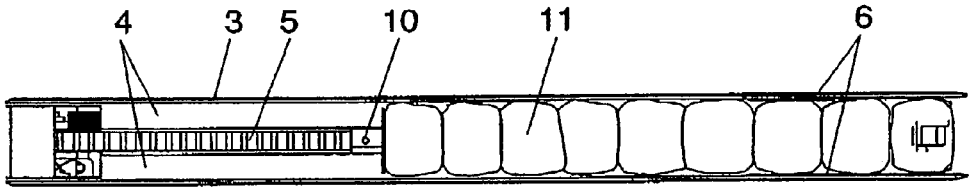
FIG. 4. Shows a plan view of the previous figure, where the dragging pincer can be seen together with the lateral strips for the products backed on to the side wall of the compartment.
Figure 5:
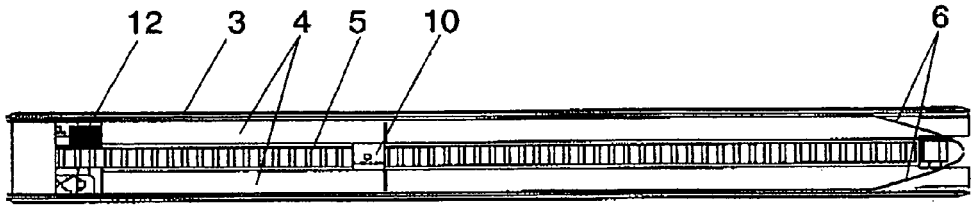
FIG. 5. Shows a plan view of a compartment without products, where the pair of strips can be seen converging to the center of the compartment for pressing on the products.

In view of the figures commented on and in accordance with the numbering adopted, we can see how the automatic dispensing machine 1 presents a plurality of trays 2 with a series of compartments 3 for the depositing of the products 11 to be dispensed. Also, the means for the introduction of coins, bank notes and/or cards 16 is shown.

The automatic dispensing machine 1 also presents a reception tray 7 for the product to dispense from the compartments 3 for being led to the slot 13 for collection by the user, the reception tray 7 likewise incorporating a belt 8 with a pusher for pushing the product to the collection slot.

Moreover, the compartments 3 consist of a laminar base 4 in its central part for the provision of a toothed belt 5 which, when driven by the corresponding motor 12, will cause the advance of the products with the aid of a pusher 10 fixed to the belt 5, this pusher 10 being backed on to the product located in last place.

The said pusher 10 remains fitted to the belt 5 by means of clamping it and being secured to it due to its rotary arm 14 being restrained by a spring 15 between two contiguous teeth of said belt 5.

In this way, the pushing and extraction system for the requested product 11 is defined by a single pusher 10 secured to the belt 5 provided with a plurality of projections, this securing being materialised by means of a rotary arm 14 of the pusher restrained by a spring 15, with its lower end being positioned between two curved projections of the belt, the pusher 10 remaining in its initial position backed on to the product that is most internal of all the products 11 aligned in the corresponding compartment 3 of a tray 2.

Moreover, in the actuation of the motor 12 and displacement of the belt 5, the pusher 10 for the products 11 abuts on a retainer (17) in the forward part of the actual laminar base 4 for the depositing of products 11, in such a way that the retainer (17) prevents the pusher from being displaced forward even when the belt 5 is advanced.

In the normal functioning of the machine, when a product 11 is dispensed from one of the compartments 3, it acts on one of the cells 9 as it falls towards the reception tray 7, causing the corresponding motor 12 to halt.

Also, with the pusher 10 abutting on the retainer (17) on the forward part of the laminar base for the depositing of the products, when a new request is made for a product 11, the advance of the belt 5 overcomes the action of the spring restraining the rotary arm of the pusher positioned between two contiguous curved projections, with the pusher 10 remaining static.

In the filling operation, the pusher 10 will be returned to its initial position, manually, by overcoming the action of the spring restraining the rotary arm and sliding it towards the rear part of the belt 5.

Figure 6:
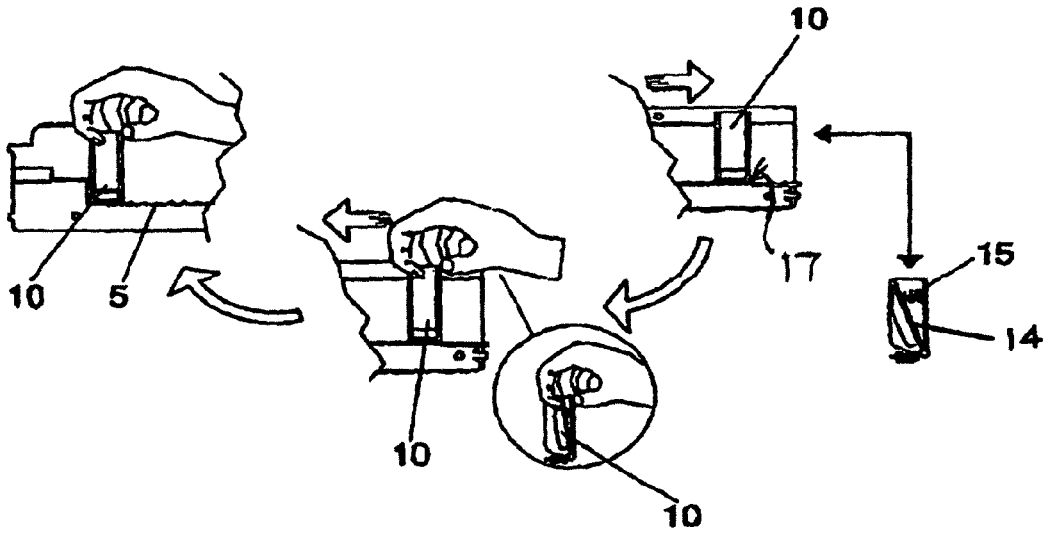
FIG. 6. Shows the sequence to follow for returning the pincer to its initial position for the retaining position
Figure 7:
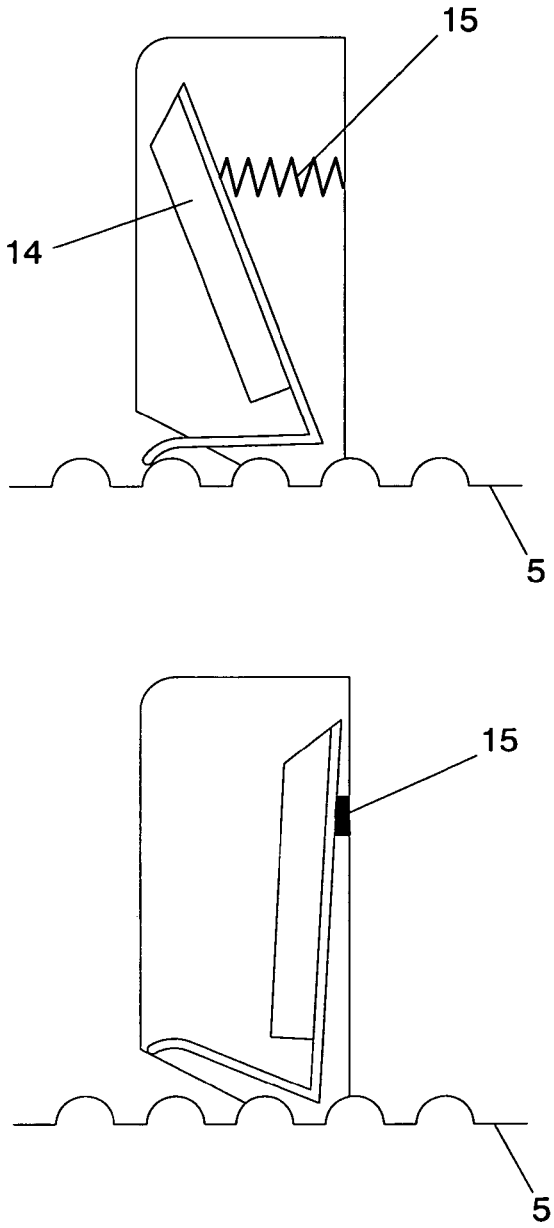
FIG. 7 illustrates the rotary arm of the pusher and its relationship to the contiguous curved projection of the belt. Further.
Figure 8:
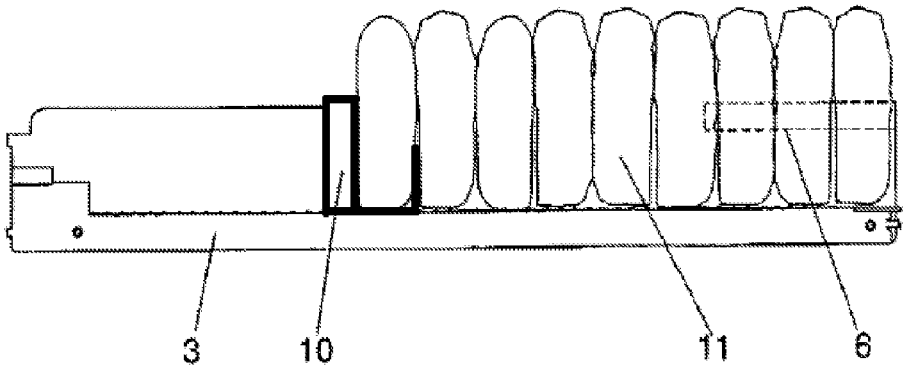
FIG. 8 shows a side elevation view of a compartment for depositing the products, where a pusher can be seen.
Figure 9:
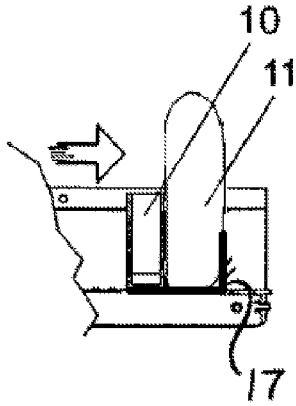
FIG. 9 shows a side elevation view of the pusher in the retaining position with one product left in the compartment and FIG. 10 shows a side elevation of the pusher.
Figure 10:
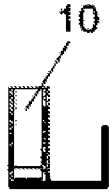

In FIG. 6 of the designs, it can be seen how, once the pusher 10 abuts on the retainer (17) in the forward part of the compartment 3, when the corresponding compartment 3 is manually filled, the pusher will be displaced towards the rear part with the entire compartment being filled with products 11.

Moreover, in an initial practical embodiment of the invention, the dragging pusher 10 for the products 11 abuts on the retainer (17) in the forward part of the compartment 3 when the last product 11 has been dispensed, and the compartment is left completely empty.

In a second practical embodiment of the invention, the dragging pusher 10 for the products 11 abuts on the retainer (17) in the forward part of the compartment 3 when the last product but one 11 has been dispensed, with one remaining undispensed, in such a way that when a user requests that product, even though the motor 12 is actuated and the belt 5 advances, the pusher 10 remains static and the product is not dispensed.

This embodiment presents the advantage of being able to know the number of sales "lost", in other words, all those requests for a product which were not able to be attended, and thereby learn the demand for the different products so that, depending on this, the variety of products to be dispensed can be varied.

With the aim of retaining the products 11 in order to prevent the possibility of products falling and not being counted, provision has been made in the forward part of the compartments 3 for a pair of strips 6 arranged in a transverse position converging towards the center of the compartment.

Also, even when an attempt is made to move the machine with the aim that products might fall to the reception tray and so obtaining them fraudulently, the pair of strips 6 prevent them from falling, acting with total reliability.

Likewise, the pair of strips 6 present the advantage of being valid for all kinds of product, and it can be seen how the pair of strips "clutch" the product located in first place, stopping it from falling.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

The invention claimed is:

1. UNITARY EXTRACTOR SYSTEM FOR PRODUCTS IN DISPENSING MACHINES, being of the type of dispensing machine which works by means of the introduction of coins, bank notes and/or cards and which can dispense food products, refrigerated or otherwise, and drinks, wherein the products are stored in corresponding compartments of a series of trays, said compartments comprising a center opened laminar base, with a belt provided with a plurality of toothed projections being fitted in relation to the opened central part of the laminar base, a pair of lateral strips disposed in their forward part being arranged in a transverse position and converging towards the center of said compartments, the pair of lateral strips being capable of clutching products of any shape for securing them, and wherein, upon the advance of the belt for the extraction of a product, said pair of lateral strips give way to the first product that is released towards an extraction tray, while the product positioned in second place is halted by the pair of lateral strips at the same time as the belt is detained, wherein the unitary extractor system further comprises a single pusher secured to the belt, this securing being materialized by means of a rotary arm of the pusher restrained by a spring, wherein the lower end of the rotary arm is positioned between two toothed projections of the belt and the pusher remains leaned against the product that is most internal of all the products lined up in the corresponding compartment of a tray, and wherein the center opened laminar base comprises a retainer in its forward part which stops the forward movement of the pusher, even when the belt is advanced, when the last product but one has been dispensed with one remaining undispensed although a user requests the one remaining undispensed product owing to the fact that the belt continues its advance overcoming the action of the spring restraining the rotary arm of the pusher, thus configuring the dispensing machine as a lost sales counter.

2. UNITARY EXTRACTOR SYSTEM FOR PRODUCTS IN DISPENSING MACHINES, according to claim 1 wherein in the filling operation the pusher will be returned to its initial position, manually, by overcoming the action of the spring restraining the rotary arm and sliding it to the rear part of the belt.

* * * * *